US006321966B1

(12) United States Patent
Blanchard et al.

(10) Patent No.: US 6,321,966 B1
(45) Date of Patent: Nov. 27, 2001

(54) DEVICE FOR AUTOMATICALLY CATCHING A TORN MATERIAL WEB RUNNING THROUGH A ROTARY PRINTING MACHINE

(75) Inventors: Alain Blanchard, Gouvieux; Francois Recolet, Breuil-le-Vert, both of (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/415,730

(22) Filed: Oct. 12, 1999

(51) Int. Cl.[7] ..... B65H 23/34; B65H 43/04; B41F 13/54

(52) U.S. Cl. ..... 226/11; 226/88; 226/186; 226/175; 101/228; 101/484

(58) Field of Search ..... 226/11, 88, 100, 226/186, 194, 175; 101/92, 228, 484; 34/620

(56) References Cited

U.S. PATENT DOCUMENTS 4,549,485 * 10/1985 Nawrath ..... 101/228 X
4,846,060 * 7/1989 Proctor ..... 101/228
5,036,765 * 8/1991 Keilhau ..... 101/228
5,063,845 * 11/1991 Perretta ..... 101/484
5,188,028 * 2/1993 Reichel ..... 101/228
5,372,290 * 12/1994 Marmin ..... 101/228 X
5,443,008 * 8/1995 Pavliny et al. ..... 101/484
5,678,484 * 10/1997 Callan et al. ..... 101/228 X

FOREIGN PATENT DOCUMENTS 0 092 659 A1 11/1983 (EP) .
0 741 033 A2 11/1996 (EP) .

* cited by examiner

*Primary Examiner*—Michael R. Mansen
(74) *Attorney, Agent, or Firm*—Herbert L. Lerner; Laurence A. Greenberg; Werner H. Stemer

(57) ABSTRACT

A device for automatically catching a torn material web running through a rotary printing machine includes a pair of clamping rollers, respectively, disposed beneath and above the material web, the rollers being rotatingly entrainable and being able to clamp the web when a web tear is detected, at least one of the clamping rollers having variable outer main dimensions, and an actuator connected to the at least one clamping roller for causing the outer main dimensions thereof to increase upon detection of a web tear, so as to clamp the torn material web between the clamping rollers.

14 Claims, 15 Drawing Sheets

DEVICE FOR AUTOMATICALLY CATCHING A TORN MATERIAL WEB RUNNING THROUGH A ROTARY PRINTING MACHINE

BACKGROUND OF THE INVENTION

Field of the Invention

The invention of the instant application relates to a device for automatically catching a torn material web running through a rotary printing machine, the device having a pair of clamping rollers, respectively, beneath and above the material web, the rollers being rotatingly entrained and being able to clamp the web when a web tear is detected.

The invention has a particularly advantageous application in the printing sector, in that it can avoid jamming by winding a material web on a blanket cylinder of the last printing unit, when a material web running continuously through a rotary offset printing machine is torn.

The offset printing units usually have four parallel cylinders which are in outer surface contact with one another via one of the jacket lines thereof. The printed material web runs between the two central cylinders, the so-called "blanket cylinders", which are covered by a blanket formed by an elastomer-coated canvas. Because the printing ink for the printing of the material web is usually highly viscous, the material web consequently adheres to the damp blanket cylinders. When the printing machine is in operation, the material web is tensioned or tautened to a very pronounced extent by rollers such as infeed rollers located upline of the printing units, and cooling rollers arranged downline of the printing units and a dryer.

The tensioned material web is then separated or stripped off the damp blanket cylinders. If the web becomes torn, the separation thereof from the cylinders abruptly stops. Furthermore, when hot-drying offset printing inks are used, there is provided in the printing machine a dryer having a length of from 8 to 12 meters that serves for vaporizing the solvent of the ink applied to the material web and for polymerizing the resin thereof.

The dryer is arranged downline of the printing units and is traversed by the continuous printed material web that does not have to be supported by rollers.

Because the dry material web is less elastic than the damp web, the dry material web may become torn in the dryer.

If the material web tears inside the dryer, it usually winds itself around a blanket cylinder of the last printing unit due to the adhesive capacity of the ink applied to the web, the adhesive capacity, in specific cases, being capable of producing very large adhesive forces. Following a given number of rotations, if the number of material layers has reached a sufficient value, the torn web that has been wound around the blanket cylinder may damage the blanket or the cylinder.

Before the printing machine runs down completely, there is a very great risk of two material layers winding around the blanket cylinder during each revolution of the latter, one material layer coming from the printing unit and the other coming from the dryer.

In order to avoid the foregoing disadvantages, the European Patent 0 092 659 has disclosed heretofore a so-called turn-back safety device of the type described in the introduction hereto for a torn material web.

This heretofore known device is located between the last printing unit and the dryer. A main part of this device is formed by a pair of clamping rollers including a fixed roller located laterally beneath the continuous material web and a pressure-exerting roller arranged above the web, the rollers, respectively, being entrained with the material web at the running speed of the latter.

In normal operation, the rollers are kept apart from one another during the running of the paper, so that the printed damp web can run past the rollers without contact, and no smearing occurs. When the paper web tears, the tearing is reliably detected by optical sensors which are arranged at the outlet of the last printing unit, and a releasing signal is directly transmitted to a holder for holding back the spaced-away pressure-exerting roller.

The pressure-exerting roller is then released and brought into the clamping position for clamping the torn material web.

As long as the printing machine is not switched off, the material web oncoming from the last printing unit continues to run and winds around one of the two clamping rollers of the respective device, instead of winding around one of the blanket cylinders of the printing unit.

The diameter of the roller around which the paper winds becomes greater, while the other roller yields so as to permit the material take-up to occur.

The disadvantage of such a device resides mainly in the fact that the rotating and laterally displaceable arrangement of one of the clamping rollers for positioning it in a spaced-away position or in a position wherein it engages the material web is quite complex, and the rotary printing machine thus becomes more sluggish.

Furthermore, this complex construction means that the operator does not have ready access to the respective clamping roller.

Furthermore, a device of this type has a relatively lengthy response time resulting from the physical displacement of one of the clamping rollers relative to the other.

SUMMARY OF THE INVENTION

It is accordingly an object of the invention to provide a device for automatically catching a torn material web running continuously through a rotary printing machine which avoids the aforementioned disadvantages of heretofore known devices of this general type.

With the foregoing and other objects in view, there is provided, in accordance with the invention, a device for automatically catching a torn material web running through a rotary printing machine, comprising a pair of clamping rollers, respectively, disposed beneath and above the material web, the rollers being rotatingly entrainable and being able to clamp the web when a web tear is detected, at least one of the clamping rollers having variable outer main dimensions, and an actuator connected to the at least one clamping roller for causing the outer main dimensions thereof to increase upon detection of a web tear, so as to clamp the torn material web between the clamping rollers.

In accordance with another feature of the invention, the clamping rollers are movable in a manner other than translatorily.

In accordance with a further feature of the invention, each of the clamping rollers has a respective rigid cylindrical body, and the web-catching device includes an inflatable sheath fitted on the outer circumferential surface of the rigid body, and connected to a pressure-medium supply for supplying pressure medium to the inflatable sheath for inflating the sheath, upon detection of a web tear, so as to increase the outer main dimensions of the respective clamping roller.

In accordance with an added feature of the invention, the inflatable sheath is formed by a sleeve with a deformable wall slidable onto the rigid cylindrical body of the respective clamping roller and clampable thereon, the wall of the sleeve being preformed so that, along the width of the roller, a plurality of inflatable chambers which are connected to the pressure-medium supply are defined with the circumferential surface of the rigid body.

In accordance with an additional feature of the invention, the inflatable sheath comprises a sleeve with a deformable wall that is slidable at both ends onto the rigid cylindrical body of the respective clamping roller and clampable thereon, the sleeve having, over a majority of the length thereof, an internal diameter greater than the external diameter of the rigid body of the respective roller, so that a free space is formed between the sleeve and the rigid body, the web-catching device including clamping rings clampable around the sleeve on the rigid cylindrical body and distributed at regular intervals over the width of the roller, so as to define inflatable chambers connected to the pressure-medium supply.

In accordance with yet another feature of the invention, the inflatable sheath comprises a plurality of individual sleeves, respectively, having a deformable wall, the individual sleeves being slidable successively onto the rigid cylindrical body of the respective clamping roller and clampable thereon, an inflatable chamber connected to the pressure-medium supply being defined between each of the individual sleeves and the respective roller.

In accordance with yet a further feature of the invention, each of the clamping rollers has a wave-shaped or corrugated cylindrical outer surface.

In accordance with yet an added feature of the invention, the two outer circumferential surfaces of the two clamping rollers have wave-shaped or corrugation profiles corresponding to one another so that, in a clamping position, outwardly projecting peaks of the waves or corrugations of the outer surface of one of the clamping rollers are supported on outwardly projecting peaks of the waves or corrugations of the outer surface of the other clamping roller.

In accordance with yet an additional feature of the invention, the two outer circumferential surfaces of the two clamping rollers have wave-shaped or corrugation profiles offset by half a pitch spacing relative to the width of the rollers, so that, in a clamping state of the clamping rollers, outwardly projecting peaks of the waves or corrugations of the outer surface of one of the clamping rollers are supported on inwardly projecting peaks of the waves or corrugations of the outer surface of the other clamping roller.

In accordance with still another feature of the invention, the pressure-medium supply comprises a container connectable via a quick-action solenoid valve alternatively to a pressure-medium supply network and to a line network provided in the rigid cylindrical body of the clamping roller and terminating on the outer surface of the rigid body, the web-catching device including a web-tear detection system for controlling the quick-action solenoid valve.

In accordance with still a further feature of the invention, the pressure medium is compressed air.

In accordance with still an added feature of the invention, the clamping rollers are installed for rotating in bearings on the operator side, the bearings being swivellable about a spindle for quickly releasing an access opening to the clamping rollers.

In accordance with still an added feature of the invention, each of the swivel bearings is linked to a respective spindle as a pressure-cylinder system.

In accordance with still an additional feature of the invention, the two clamping rollers have variable outer main dimensions.

In accordance with a concomitant feature of the invention, only one of the two clamping rollers has variable outer main dimensions.

There is accordingly proposed a novel automatic device that is intended for automatically catching a torn material web running through a rotary printing machine, and having a straightforward construction that allows an operator rapid access to one clamping roller or the other, and for which the response time, upon detection of a web tear, is considerably reduced.

In particular, the device for automatically catching a torn material web running through a rotary printing machine comprises, according to the invention, a pair of clamping rollers which are located, respectively, beneath and above the material web, the clamping rollers being rotatingly entrained and, upon detection of a web tear, being able to clamp the web.

At least one of the clamping rollers is constructed so that it has variable outer main dimensions and is connected to an actuating device that is suitable for causing the outer main dimensions of the roller to increase upon detection of a web tear, so that the torn material web can be clamped between the clamping rollers.

In the automatic device according to the invention, the clamping rollers advantageously do not execute any translatory movement.

The mechanical response time of the automatic web-catching device is thus, according to the invention, very short because the clamping rollers cannot move in a translatory manner.

A preferred feature of the automatic web-catching device according to the invention is an inflatable sheath that fits on the outer circumferential surface of a rigid body of the clamping roller and is connected to a supply for providing the inflatable sheath with pressure medium, so that, upon detection of a web tear, the sheath is inflated for the purpose of increasing the outer main dimensions of the clamping roller.

According to a preferred embodiment, the response time, upon detection of a web tear, is thus very short because there is little movement of masses. All that is required is to inflate a sheath after it has been pushed or slid onto a rigid body of the clamping roller.

According to this preferred embodiment, provision may be made for the sheath to be formed by a sleeve with a deformable wall which is pushed onto the rigid cylindrical body of the clamping roller and clamped thereon, the wall of the sleeve being preformed in order, along the width of said roller, to define or limit, with the circumferential surface of the rigid body, a plurality of inflatable chambers which are connected to the pressure-medium supply.

According to a development of the invention, provision may be made for the inflatable sheath to comprise a sleeve with a deformable wall which, at the respective ends, is pushed or slid onto the cylindrical body of the roller and clamped thereon, the sleeve having, over the majority of the length thereof, an internal diameter that is greater than the external diameter of the rigid body of the roller, with the result that a free space is produced between the sleeve and the rigid body, and clamping rings are clamped around the sleeve on the cylindrical rigid body and are distributed at regular intervals over the width of the roller, in order to define, between the sleeve and the outer surface of the rigid body of the roller, inflatable chambers which are connected to the pressure-medium supply source.

According to a development of the invention, provision may be made for the inflatable sheath to comprise a plurality of individual sleeves, each with a deformable wall, which are pushed or slid successively onto the rigid cylindrical body of the clamping rollers and clamped thereon, an inflatable chamber which is connected to the pressure-medium supply being defined between each individual sleeve and the roller.

According to an advantageous feature of the web-catching device according to the invention, each of the clamping rollers has a corrugated cylindrical outer surface.

According to one embodiment of the device according to the invention, the two outer circumferential surfaces of the clamping rollers have corrugation profiles which correspond to one another so that, in the clamping position of the roller, the outwardly projecting peaks of the corrugations of the outer surfaces of one clamping roller are supported on the outwardly projecting peaks of the corrugations of the outer surfaces of the other clamping roller.

In this case, when the material web is torn, the material web located beneath the web-catching device according to the invention, and the material web located above the web-catching device according to the invention are caught and pulled by the clamping rollers butting against the material web, and the web then winds around one of the rollers in a double layer.

According to this embodiment, it is advantageous to provide a web-tensioning adjustment system which makes it possible not to break the web winding around one of the clamping rollers as the diameter of the clamping roller about which it winds becomes greater.

According to a development, the two outer circumferential surfaces of the two clamping rollers of the device according to the invention have corrugation profiles which are offset by half a pitch spacing relative to the width of the rollers so that, in the clamping state of the clamping rollers, the outwardly projecting corrugation peaks of the outer surface of one clamping roller are supported against the inwardly projecting corrugation peaks of the outer surface of the other clamping roller.

In this case, the clamping of the material web between the two clamping rollers causes a corrugation or wave formation and thus a stiffening of the web.

By virtue of the stiffness thereof, the material web will continue its course straight ahead in the direction of the outlet of the rotary printing machine and will be collected at the outlet of the automatic web-catching device.

Once the rotary printing machine has been switched off, the operator can easily remove the torn web pieces which have collected at the outlet of the automatic web-catching device.

According to non-limiting features of the web-catching device according to the invention, the pressure-medium supply comprises a container that is connected, via a quick-action solenoid valve controlled by a web-tear detection system, alternatively to a pressure-medium supply network and to a line network, which is provided in the cylindrical rigid body of the clamping roller and terminates on the outer surface of the rigid body.

The pressure medium may be compressed air. The clamping rollers are installed rotatingly in bearings on the operator side, the bearings being articulated about a spindle in order to permit an access opening between the clamping rollers to be released quickly.

It is thus possible, once the rotary printing machine has been switched off, for the operator to gain access to the clamping rollers, in order to withdraw the torn material web which has accumulated either around one of the clamping rollers or at the outlet of the web-catching device, merely by opening the articulated bearing of a clamping roller.

If the material web has wound around a clamping roller, the operator withdraws the material web, which has rolled up in a stocking-like manner, to the side of the catching device according to the invention.

Provision may be made, in the automatic web-catching device according to the invention, for the two clamping rollers to have variable outer main dimensions or for just one of the two clamping rollers to have variable outer main dimensions, in which case the other roller is a conventional roller with constant main dimensions.

Other features which are considered as characteristic for the invention are set forth in the appended claims.

Although the invention is illustrated and described herein as embodied in a device for automatically catching a torn material web running through a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
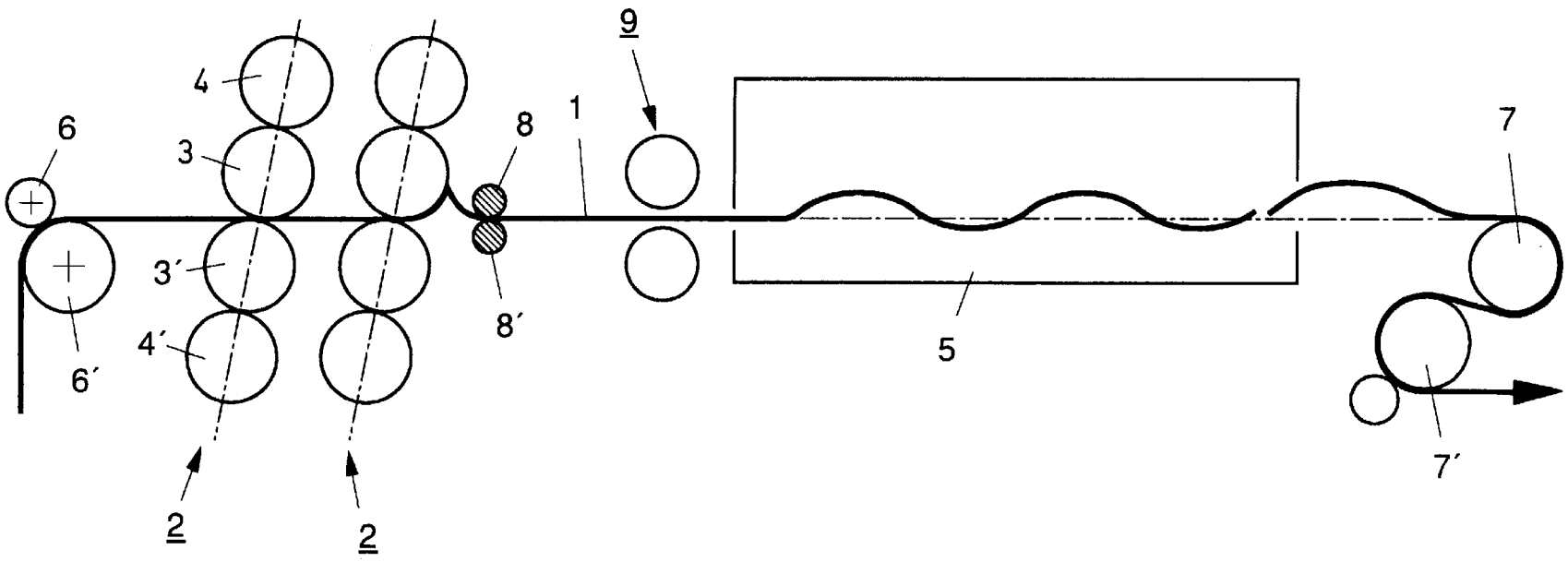
FIG. 1 is a highly diagrammatic view of an offset printing machine with hot drying, provided with an automatic web-catching device according to the invention.
Figure 2A:
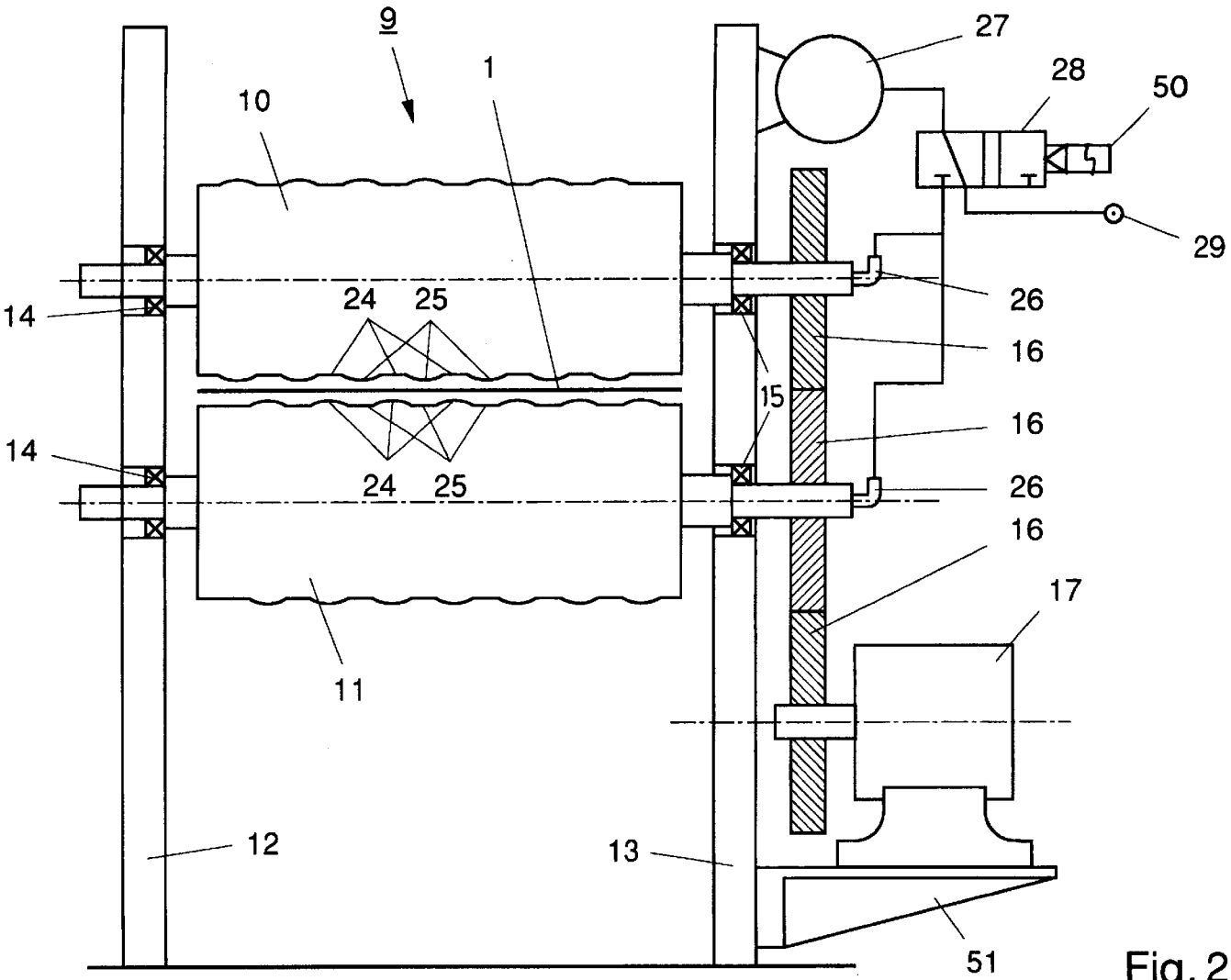
FIG. 2*a* is a partly schematic front elevational view of a first embodiment of a device according to the invention wherein opposing clamping rollers thereof are spaced from the material web.
Figure 2B:
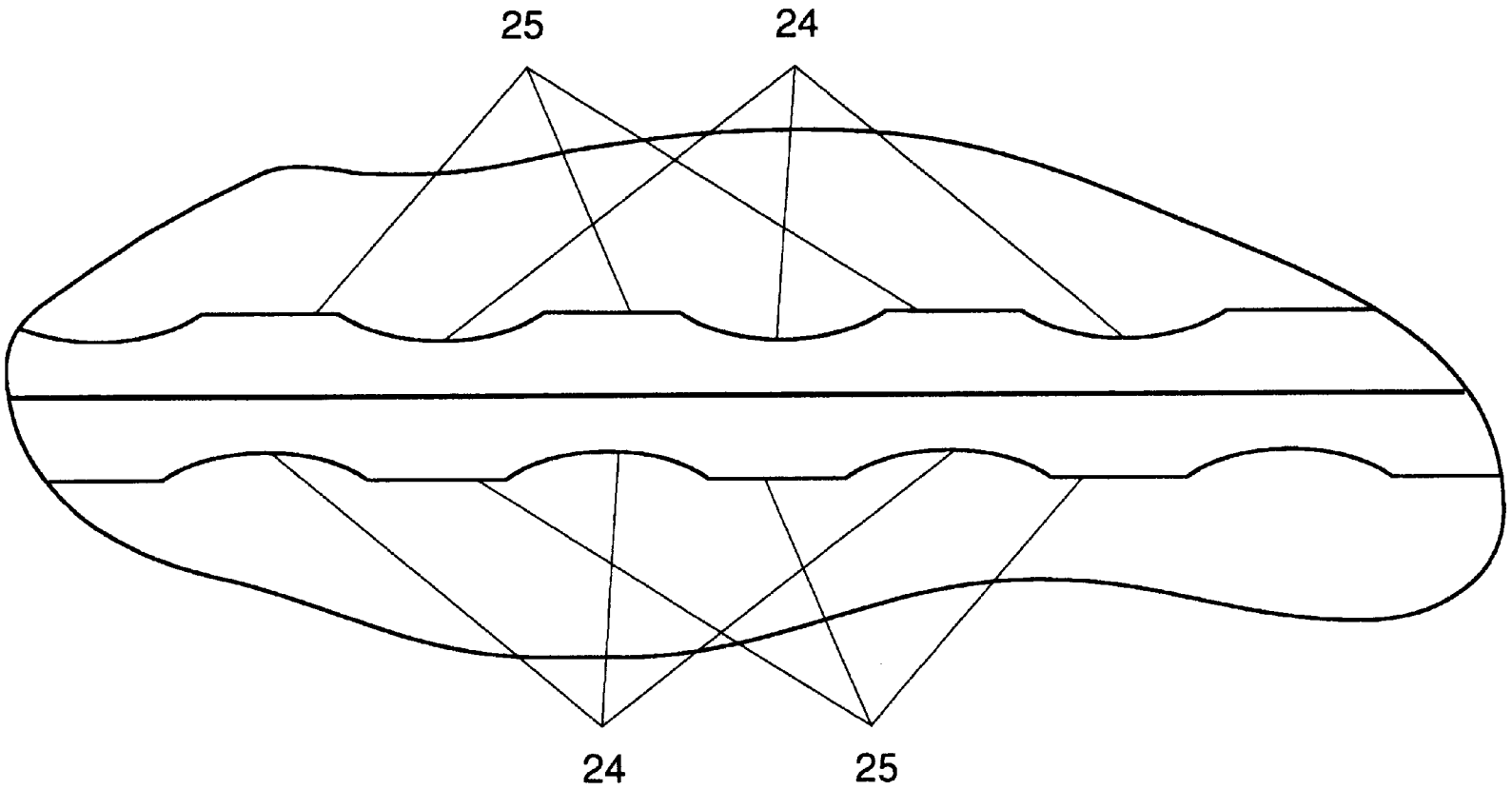
FIG. 2*b* is an enlarged fragmentary view of FIG. 2*a* showing part of the surface of the clamping rollers.
Figure 2C:
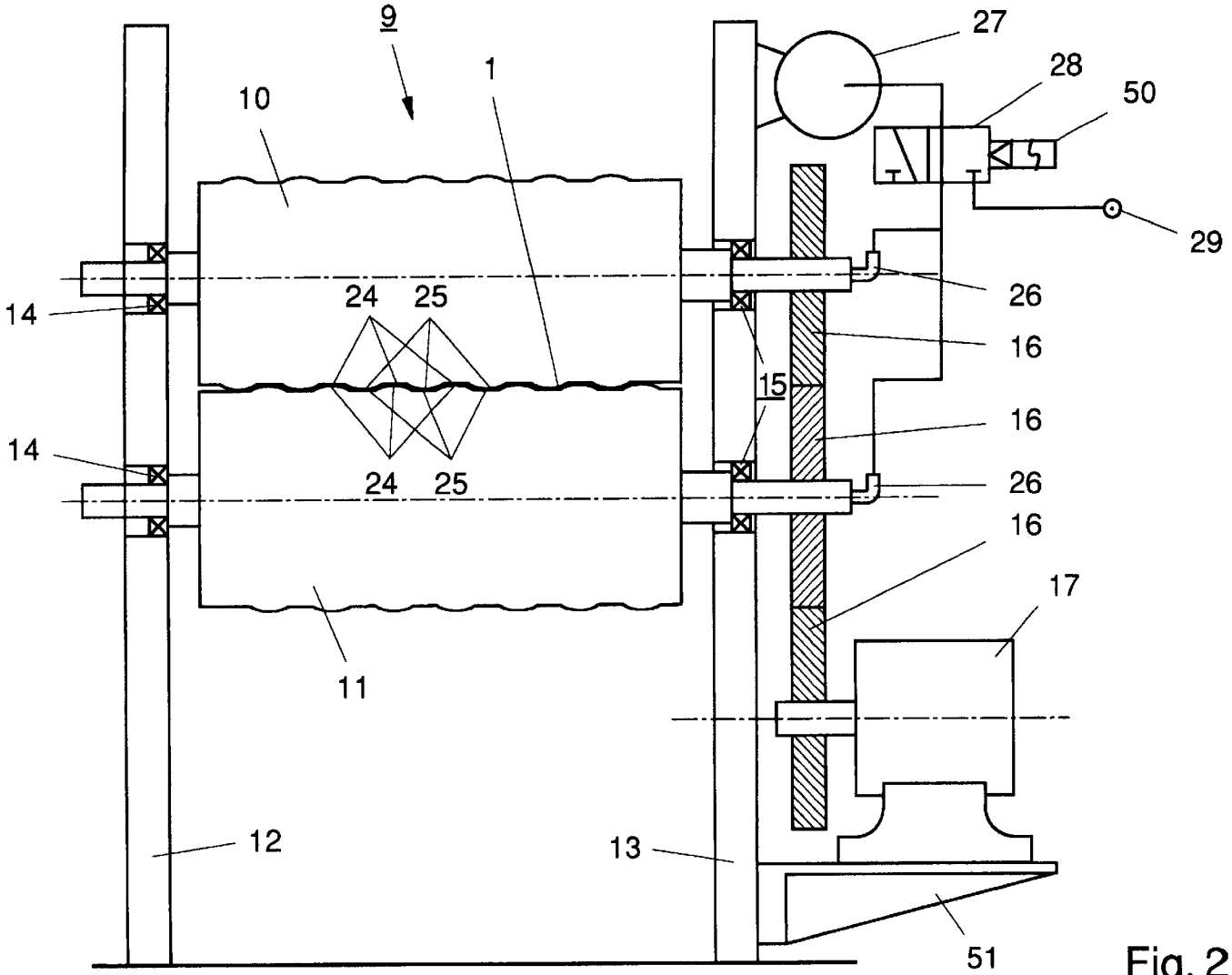
FIG. 2*c* is a view like that of FIG. 2*a*, but wherein the clamping rollers are disposed in a clamping position in engagement with the material web.
Figure 2D:
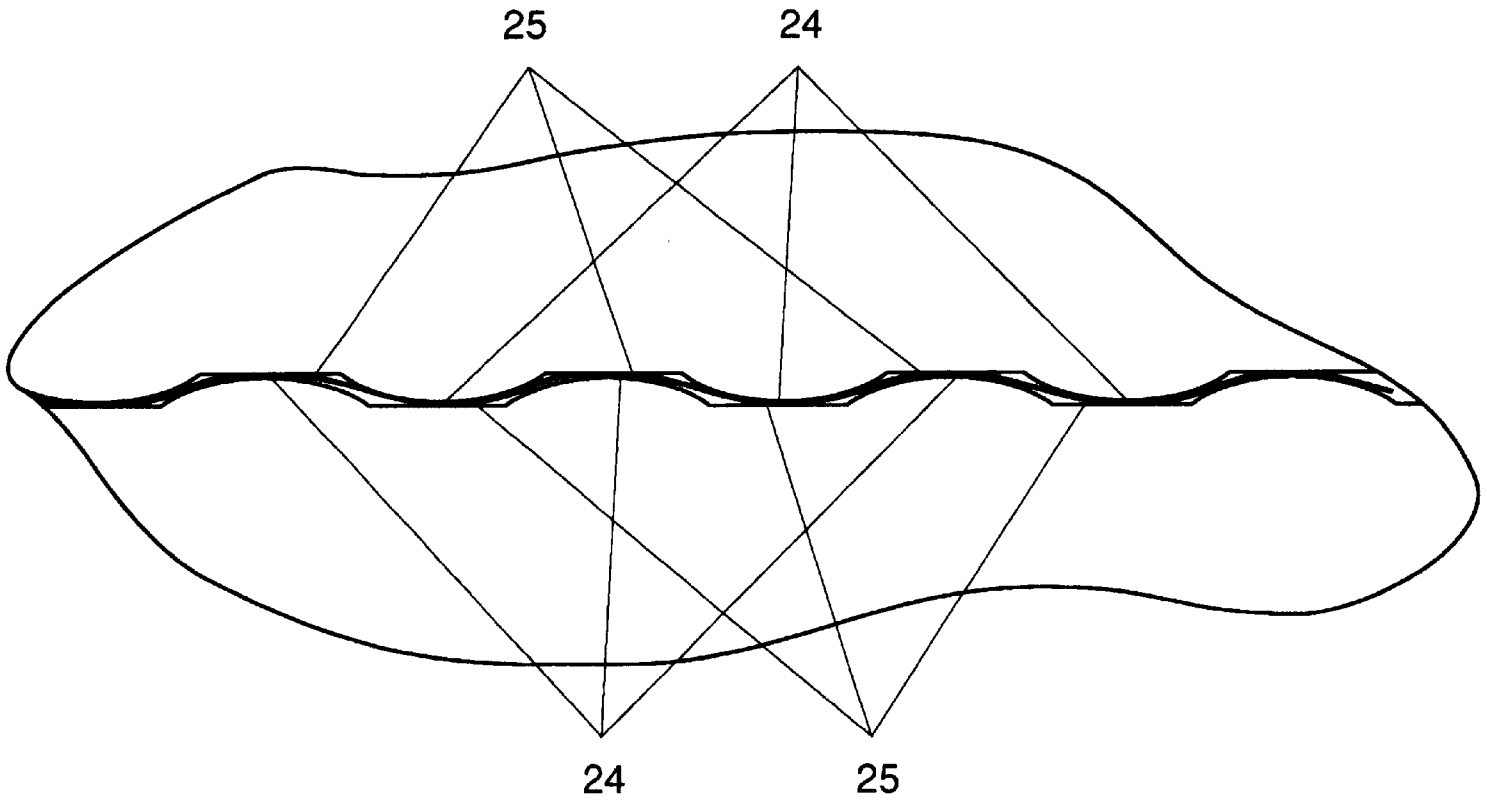
FIG. 2*d* is a view like that of FIG. 2*b* showing part of the surface of the clamping rollers illustrated in FIG. 2*c;*

As much as possible, identical or similar components in the individual figures of the drawings have been identified by like reference characters and, therefore, descriptions thereof have not been repeated.

Referring now to the drawings and, first, particularly to FIG. 1 thereof, there is shown therein, a rotary printing machine provided with two printing units 2, each of which has two blanket cylinders 3 and 3', and two plate cylinders 4 and 4', between which a material web 1 runs horizontally.

The rotary printing machine also includes a dryer 5 located downline of the last printing unit 2. The material web 1 is tensioned or tautened between two infeed rollers 6 and 6', on the one hand, and two discharge rollers 7 and 7', on the other hand, which are disposed beneath the dryer.

A detection system 8, 8', for example, an optical sensor, is provided between the outlet of the printing units 2, on the one hand, and the discharge rollers 7 and 7', on the other hand, particularly immediately following the last printing unit 2.

The detection system 8, 8' can detect tearing of the material web 1, particularly in the dryer 5 or in the region of a discharge roller 7.

In case of a web tear, the detection system can transmit a switch-on signal to an automatic web-catching device 9 positioned between the last printing unit 2 and the dryer 5, as closely as possible to the printing unit 2.

If the material web should tear, this automatic web-catching device 9 can prevent the material web 1 from rolling up in the printing units 2 and possibly cause damage to the printing units 2.

FIGS. 2*a* to 2*d* illustrate a first embodiment of the automatic web-catching device 9.

As can be seen from these figures, the automatic web-catching device 9 has two clamping rollers 10 and 11 which are located above one another, i.e., respectively, beneath and above the material web 1. They are rotatingly entrained about the horizontally extending axis thereof, parallel to the material web 1, at such a rotary speed that the external surface of the rollers 10 and 11 has a tangential speed approximately like the running speed of the material web 1.

The two clamping rollers 10 and 11 are rotatingly installed in roller bearings 14 and 15 which are provided in a framework 12 on the operator side and in a framework 13 on the control side of the rotary printing press.

The clamping rollers 10 and 11 are rotatingly driven by a motor 17 via gears 16 of a gear transmission.

The motor 17 is securely mounted on a support 51 installed on the framework 13 of the printing machine.

The motor 17 makes it possible to regulate the circumferential speed of the clamping rollers 10 and 11 in relation to the running or travel speed of the material web 1, as explained hereinbefore.

The clamping rollers 10 and 11 are thus driven at such a speed that the material web 1 can be clamped therebetween without tearing.

According to the embodiment illustrated in these figures, the two clamping rollers 10 and 11 are identically constructed so that they have variable outer main dimensions, with the result that, upon the detection of a web tear, the outer main dimensions become changed by suitable actuators so that the torn material web is clamped between the rollers 10 and 11.

These clamping rollers 10 and 11 cannot be moved translatorily.

Figure 3:
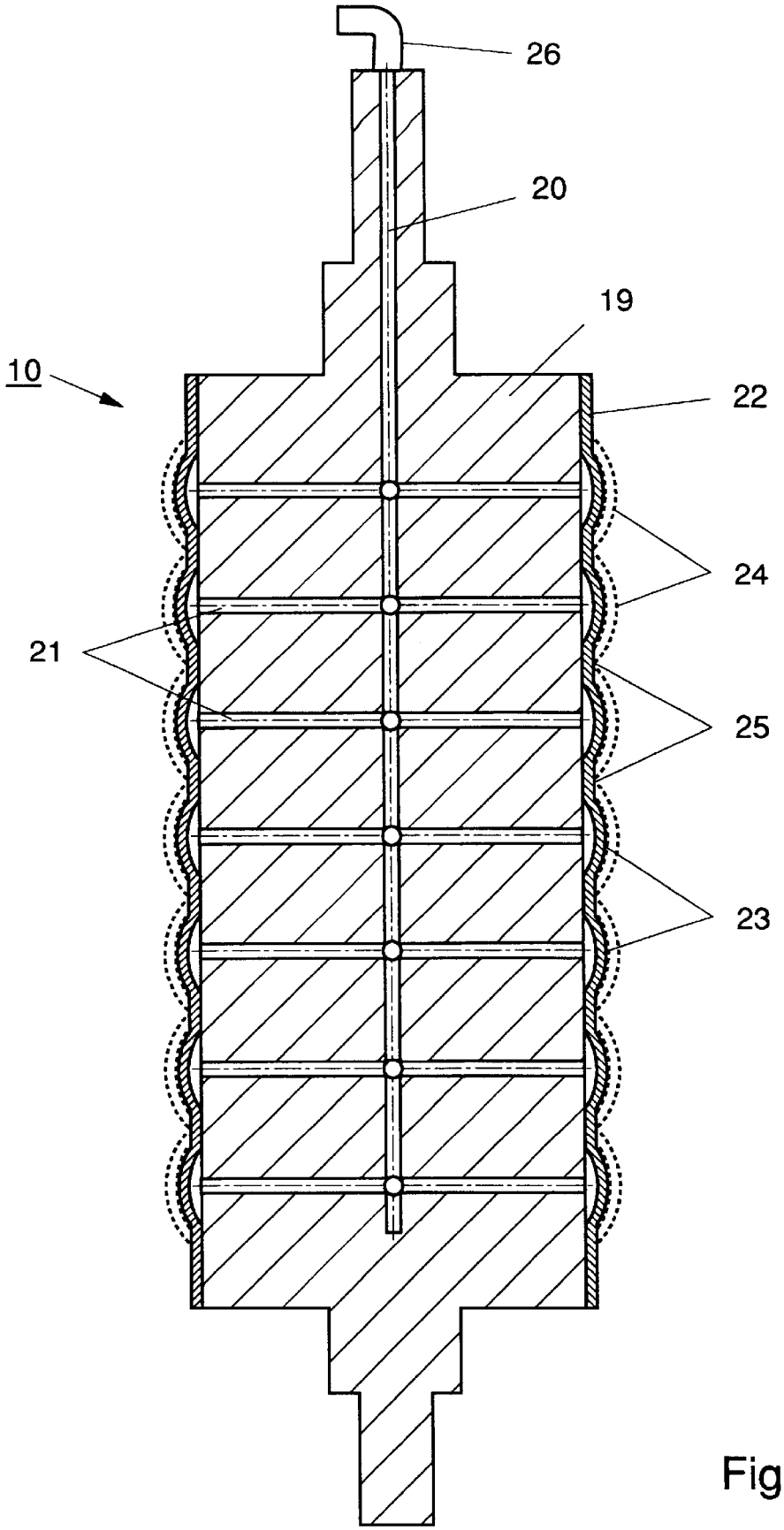
FIG. 3 is a longitudinal sectional view of one of the clamping rollers of the device shown, for example, in FIG. 2*a;*

In particular, as shown in FIG. 3, each clamping roller 10 is formed of a rigid cylindrical body of revolution 19 having ducts or channels 20 and 21 extending therethrough and terminating on the external cylindrical surface of the rigid body. The ducts 20 and 21 are a constituent part of a pressure-medium supply system.

Provided around the rigid cylindrical body 19 is an inflatable sheath 22 that is slid onto the rigid cylindrical body 19 and clamped thereon. According to the illustrated exemplary embodiment, the inflatable sheath 22 is formed by a sleeve with a deformable wall that is slid onto the rigid cylindrical body 19 of the clamping roller 10 and clamped thereon, the wall of the sleeve being preformed so that, along the width of the roller 10, there are defined, between the sleeve wall and the outer circumferential surfaces of the rigid cylindrical body 19, a plurality of inflatable chambers 23, each of which is connected to an outlet of a respective duct 21 of the rigid cylindrical body 19.

Figure 10:
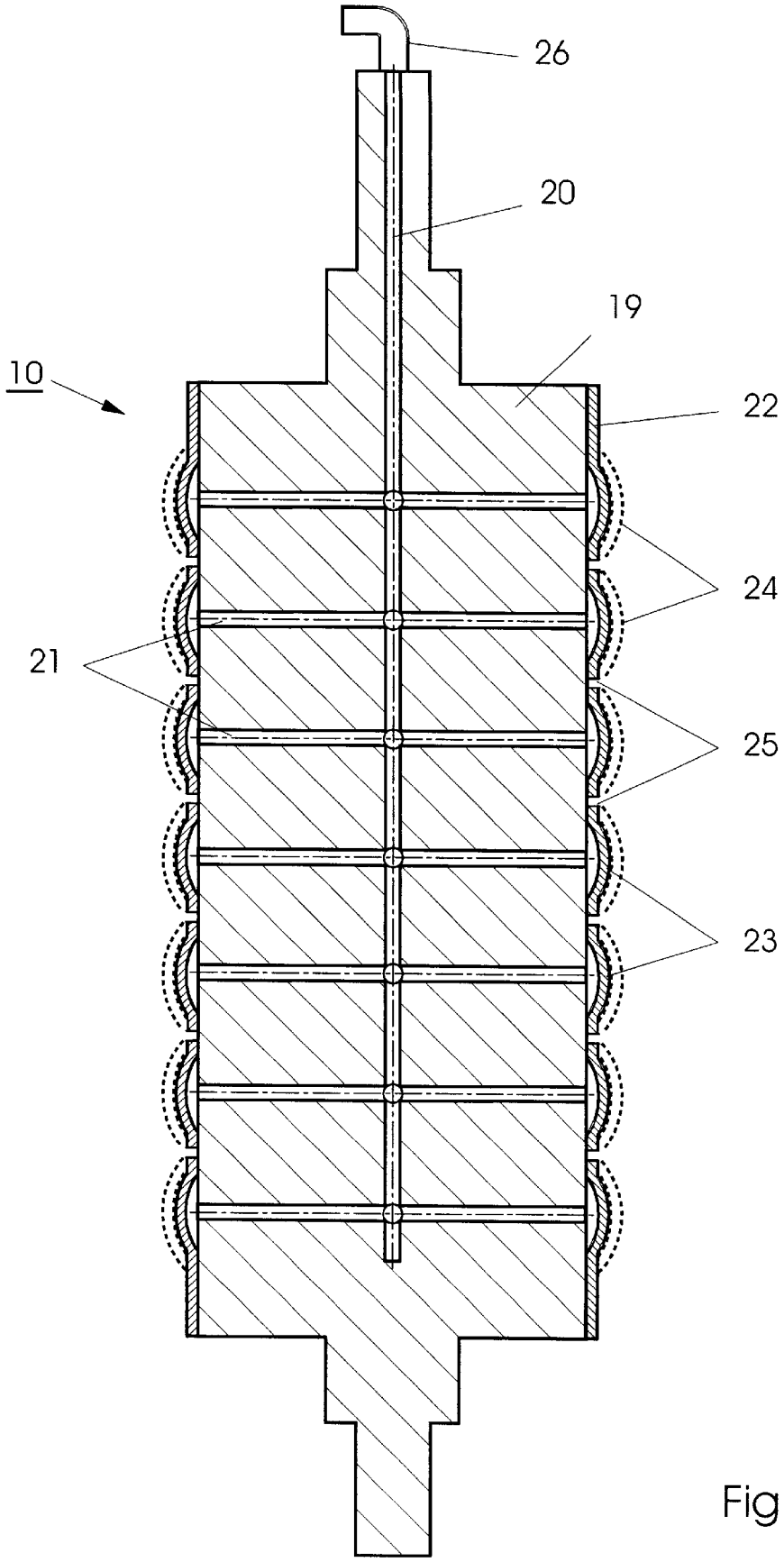
FIG. 10 is a longitudinal sectional view of an alternate embodiment of one of the clamping rollers of the device shown, for example, in FIG. 2*a*.

Of course, as an alternative to forming the inflatable sheath 22, it is possible to provide a plurality of individual sleeves, with respective deformable walls, which are slid successively onto the rigid cylindrical cylinder body 19 in accordance with the roller width and clamped thereon as shown in FIG. 10. An inflatable chamber that communicates with a respective rigid-body duct 21 is defined between each sleeve and the clamping roller 10. Each respective rigid-body duct 21 a constituent part of the pressure-medium supply system of the chambers.

The pressure-medium supply system which, in this case, supplies compressed air, includes a container 27 (note FIGS. 2*a* to 2*c* in this regard) that is connected alternatively to a compressed-air supply network 29 and to the respective chambers formed by each inflatable sheath, via the ducts 20 and 21, through the intermediary of a quick-action electrovalve 28 that is connected to the detection system 8, 8' by a control 50 so as to be activated by an electric signal generated by the detection system 8, 8' when the latter detects a tearing of the material web 1.

This construction of the supply system allows a sufficient compressed-air feed to the inflatable sheath borne by the respective clamping rollers, without a reduction in pressure in the compressed-air network as a whole and with the shortest possible response time.

When the quick-action electrovalve is in the rest position (as in FIG. 2*a*), i.e., when the material web 1 runs through in normal operating state, the valve connects the container 27 to the compressed-air supply network 29 so that the container 27 becomes filled with compressed air.

In this case, every inflatable sheath 22 is not supplied with compressed air, and the chambers are not inflated, and the clamping rollers 10 and 11 have minimal outer main dimensions, due to which the material web 1 can run through freely therebetween.

When the material web 1 tears, the quick-action electrovalve 28 receives an electric signal from the detection system 8, 8'.

This quick-action electrovalve 28 then switches off the compressed-air supply via the compressed-air circuit 29 of the container 27, and connects the latter directly to the chambers 23 of each inflatable sheath 22 by rotary seals 26.

The chambers 23 are filled with compressed air and each inflatable sheath 22 of each clamping roller 10, 11 is inflated, so that the external main dimensions of the clamping rollers 10 and 11 increase until the material web 1 is clamped between the rollers 10 and 11.

According to an advantageous special feature, the clamping rollers 10 and 11 are provided with an external, wavy or corrugated circumferential surface with wave or corrugation profiles which are offset by half a pitch spacing relative to the roller width.

The outwardly projecting peaks 24 and the inwardly projecting peaks 25 of the clamping rollers 10 and 11 are thus offset so that, in the clamping position (note FIG. 2*d*), the outwardly projecting peaks 24 of the corrugations of the outer surface of one clamping roller are supported against the inwardly projecting peaks 25 of the corrugations of the outer surface of the other clamping roller.

In fact, the circumferential surfaces of the two clamping rollers 10 and 11 interengage or engage with one another.

If it is known that the material web 1, which runs through the dryer, is no longer tensioned and becomes loose, it is expedient, for clamping the material web between a convexity of an inflatable sheath of one roller, on the one hand, and a depression of an inflatable sheath of the other roller, on the other hand, to stiffen the material web 1 by corrugation formation.

Due to the stiffness thereof, the material web 1 continues its course straight ahead, and accumulates at the outlet of the web-catching device 9.

The material web 1 does not tend to wind around one of the clamping rollers 10, 11.

Once the machine has been switched off, the operator can release the air from the inflatable sheaths 22 of the clamping rollers 10 and 11 and remove the torn web pieces. He then easily reintroduces the leading end of the material web into the printing machine.

The material web has not been able to wind around the cylinders of the printing units and thus has not been able to damage them.

Figure 4A:
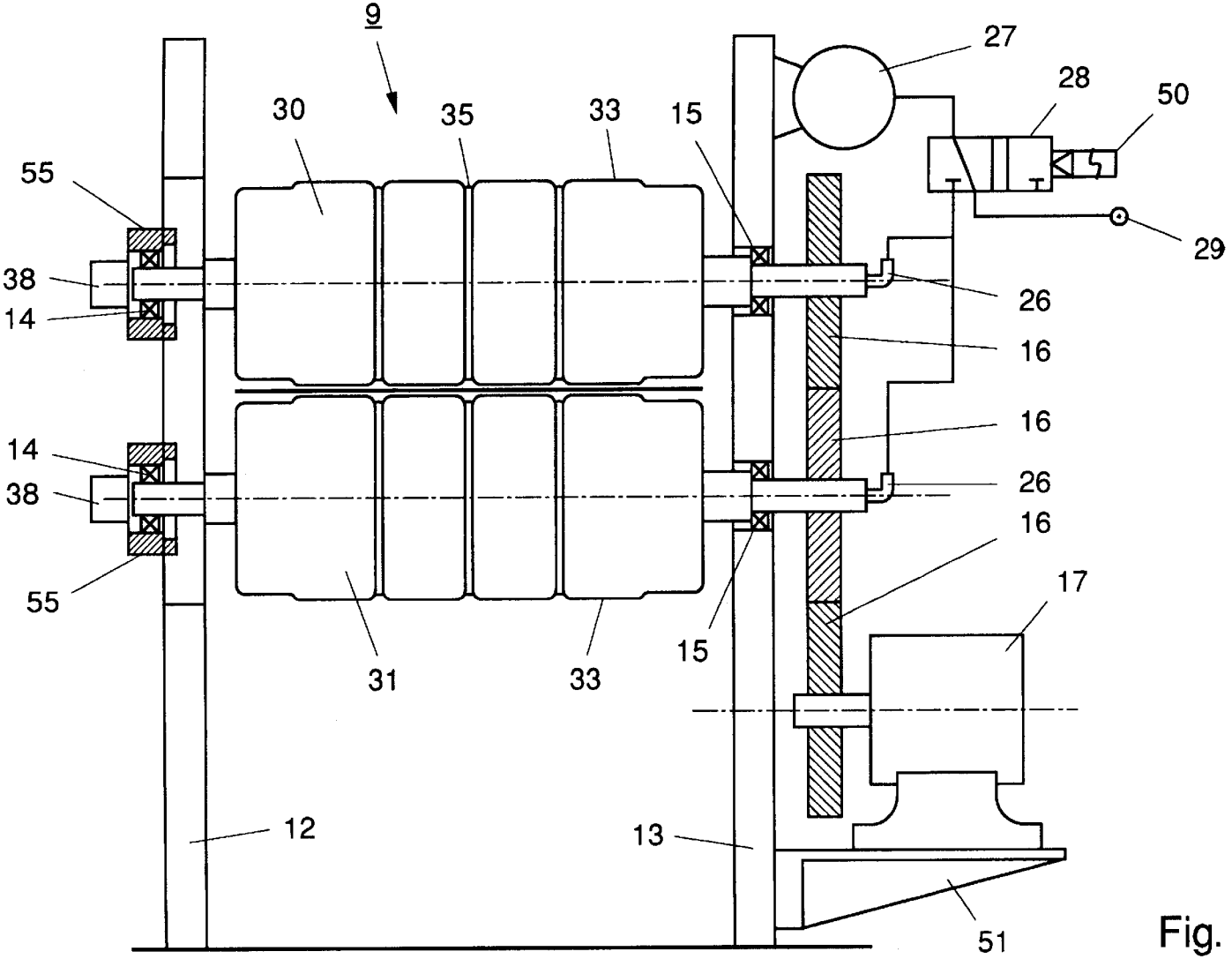
FIGS. 4*a* and 4*b* are views like that of FIG. 2*a* of a second embodiment of the device according to the invention, wherein the clamping rollers are in the spaced-apart position and in the clamping position in engagement with the material web, respectively.
Figure 4B:
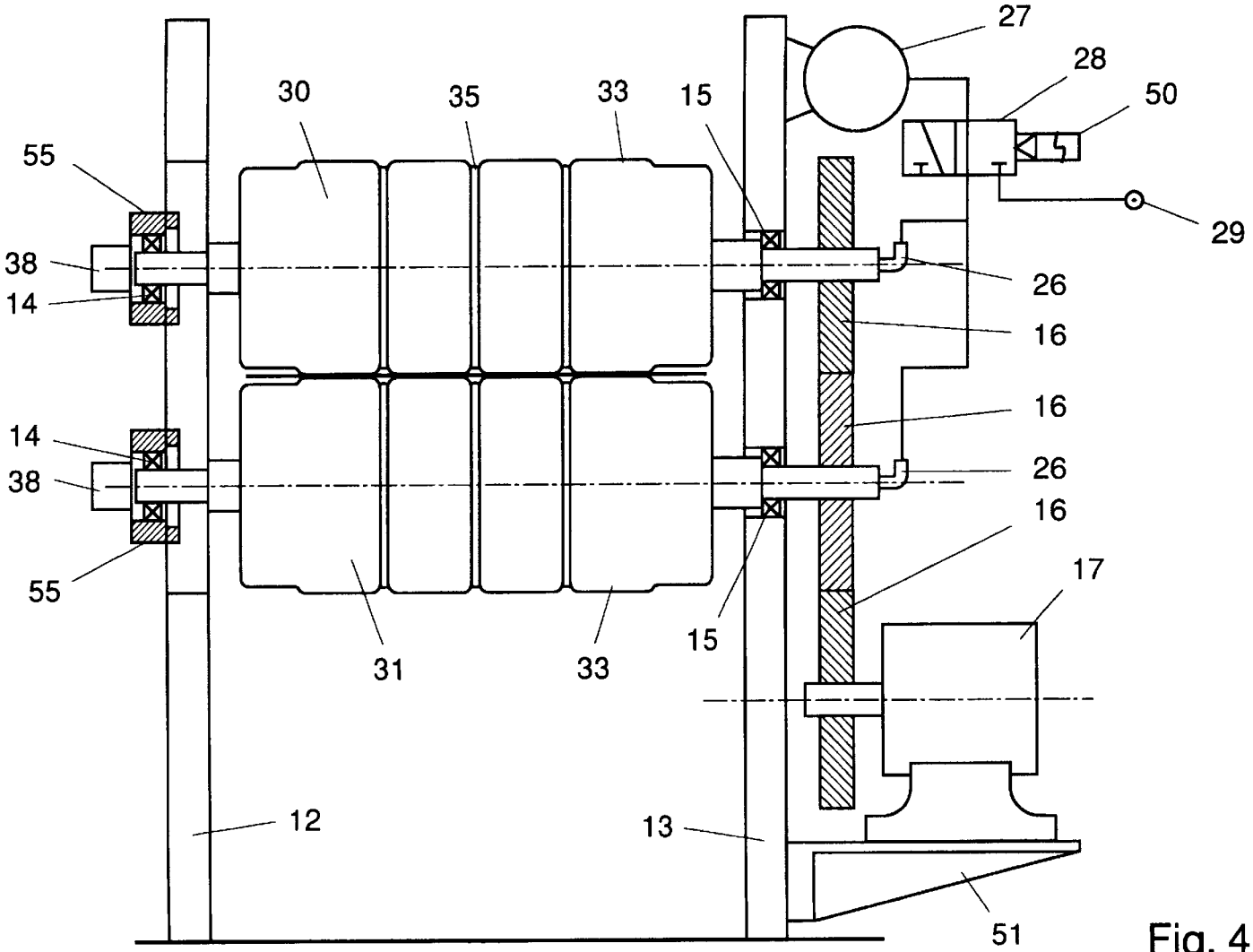

FIGS. 4*a* and 4*b* illustrate a second embodiment of the clamping rollers of the web-catching device 9.

These clamping rollers 30 and 31 are arranged, identically to the rollers 10 and 11, with the axes of rotation thereof extending parallel to the running or travel direction of the material web 1.

The clamping rollers 30 and 31 are fixed in the translatory direction and rotatingly entrained, so that the circumferential speed of the rollers is substantially equal to the running or travel speed of the material web 1.

According to this embodiment, the rollers 30 and 31 are also identical and have variable outer main dimensions.

In the normal operating state of the rotary printing machine, the outer main dimensions of the clamping rollers 30 and 31 are as small as possible, in order to allow the material web 1 to run through freely therebetween.

These rollers 30 and 31 are installed in roller bearings 14 on the framework 12 of the printing machine and in roller bearings 15 on the framework 13 of the printing machine. In an identical manner, they are driven by a motor 17 that is installed on a support 51 connected in a locally fixed manner to the framework 13 of the printing machine.

The motor 17 drives the rollers 30 and 31 simultaneously via gears 16 of a gear transmission in a manner similar to that for the rollers 10 and 11 of the first embodiment.

Figure 5:
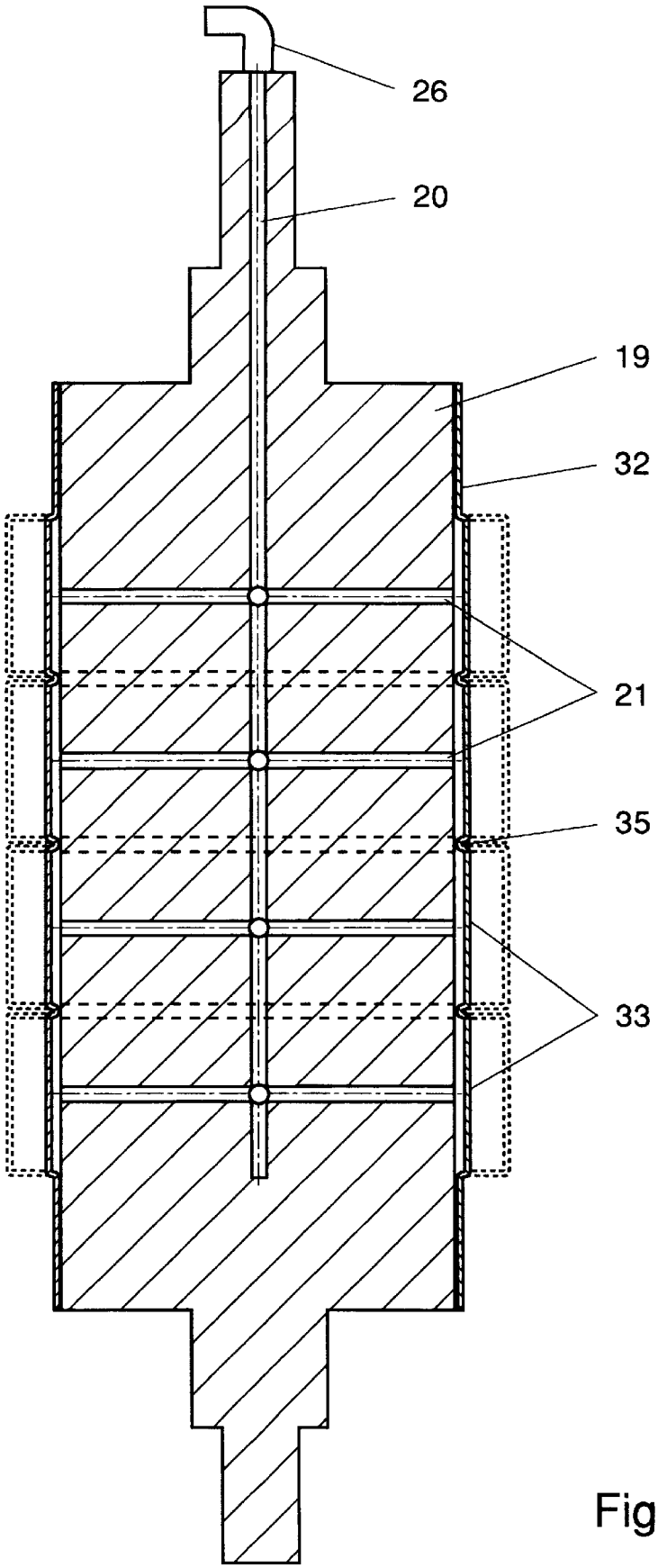
FIG. 5 is a longitudinal sectional view of one of the clamping rollers of the second embodiment of the device illustrated in FIGS. 4*a* and 4*b;*
Figure 6:
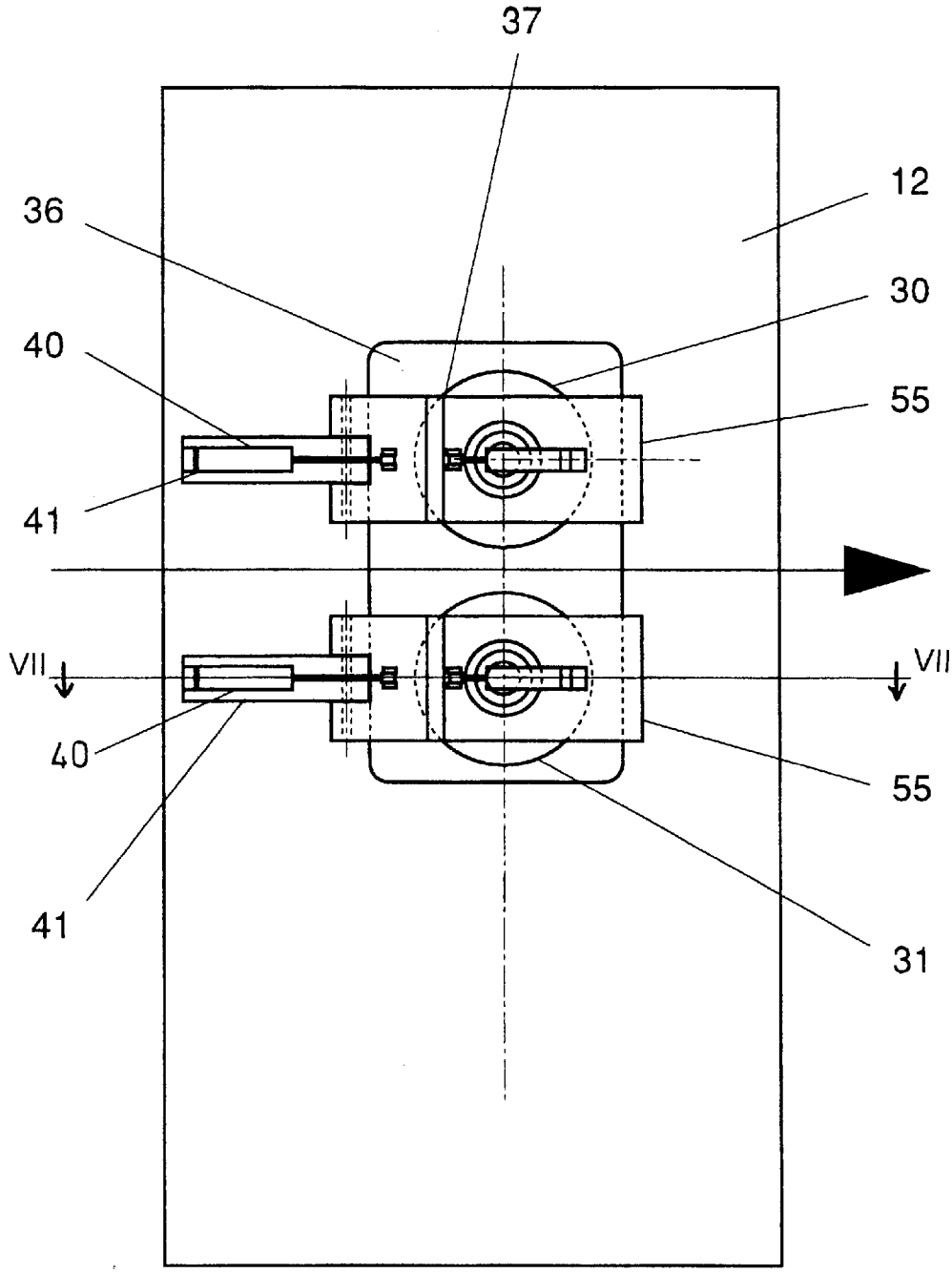
FIG. 6 is a view of the of the web-catching device according to the invention as seen from the operator side of the printing press.

As is illustrated in FIG. 5 in particular, each roller 30, 31 has a rigid cylindrical body of revolution 19 that rotates about the rotational axis thereof and is provided with pressure-medium feed ducts or channels 20 and 21 terminating on the external circumferential surface of the rigid body, the pressure medium in this case, as well, being compressed air.

Slid or pushed onto each rigid body 19 of each clamping roller 30, 31 is a sleeve with a deformable wall forming the inflatable sheath 32 that is clamped at both ends thereof onto the rigid body 19 of each clamping roller 30, 31.

In this regard, the sleeve with the deformable wall has, over the major extent of the roller width, an internal diameter that is greater than the external diameter of the rigid body of the roller, so that a free space is provided between the external circumferential surface of the rigid body 19 of each roller and the deformable wall of the sleeve.

Moreover, a number of rings 35 are slid onto the sleeve 32 with the deformable wall, the rings 35 being distributed along the entire width of each roller 30, 31 so as to form a boundary for a plurality of chambers between the external circumferential surface of the rigid body of each roller and the deformable wall of the sleeve.

This construction permits a good distribution of the compressed air when the inflatable sheath 32 is inflated, so that the external diameter is kept approximately constant along the roller, and extreme wave or corrugation formation is avoided.

The waves or corrugations are produced successively at regular intervals along the width of each roller 30, 31.

In the case wherein the air chambers are not inflated, the corrugations are as small as possible, so that the external main dimensions of the rollers are thus kept as small as possible.

In any case, the external circumferential surface of the clamping rollers has a wavy or corrugated profile.

The compressed-air supply system is identical with that described hereinbefore in conjunction with the first embodiment and will thus not be explained in detail again.

According to the embodiment illustrated in FIGS. 4*a* and 4*b*, the wave or corrugation profile of the outer surfaces of the clamping rollers 30 and 31 is of continuous or coherent construction, i.e., the chambers of the clamping rollers 30 and 31 are respectively located opposite one another.

Thus, when the chambers are inflated, the outwardly projecting peaks 33 of the rollers 30 and 31 can come into mutual engagement and, likewise, a ring 35 of a roller 30 interacts with a ring 35 of a roller 31, as is illustrated in FIG. 4*b*.

If the material web 1 tears, for example, in the dryer, part of the material web 1 is thus caught and pulled downline (relative to the web-catching device 9), and part upline, by the web-catching device 9, the clamping rollers of which are inflated.

The material web 1 then winds around one of the two clamping rollers 30, 31 in a double layer.

A web-tensioning regulating system such as a motor is advantageously provided in order to avoid renewed tearing of the web as the diameter of the clamping roller around which the torn material web winds becomes greater.

In fact, as the diameter of the roller becomes greater as the material web rolls up on the respective roller, the tensile stress applied to the material web by the roller increases more and more, and the regulating system that is provided can advantageously adjust the rotary speed of the respective roller in accordance with the rolling up of the material web.

According to an advantageous feature of the embodiment illustrated in FIGS. 4*a* and 4*b*, the rollers 30 and 31 are installed, on the operator side, in bearings 55 which are linked to and thus swivellable about a spindle or pivot pin 39 (note FIGS. 6, 7, 8 and 9).

Figure 7:
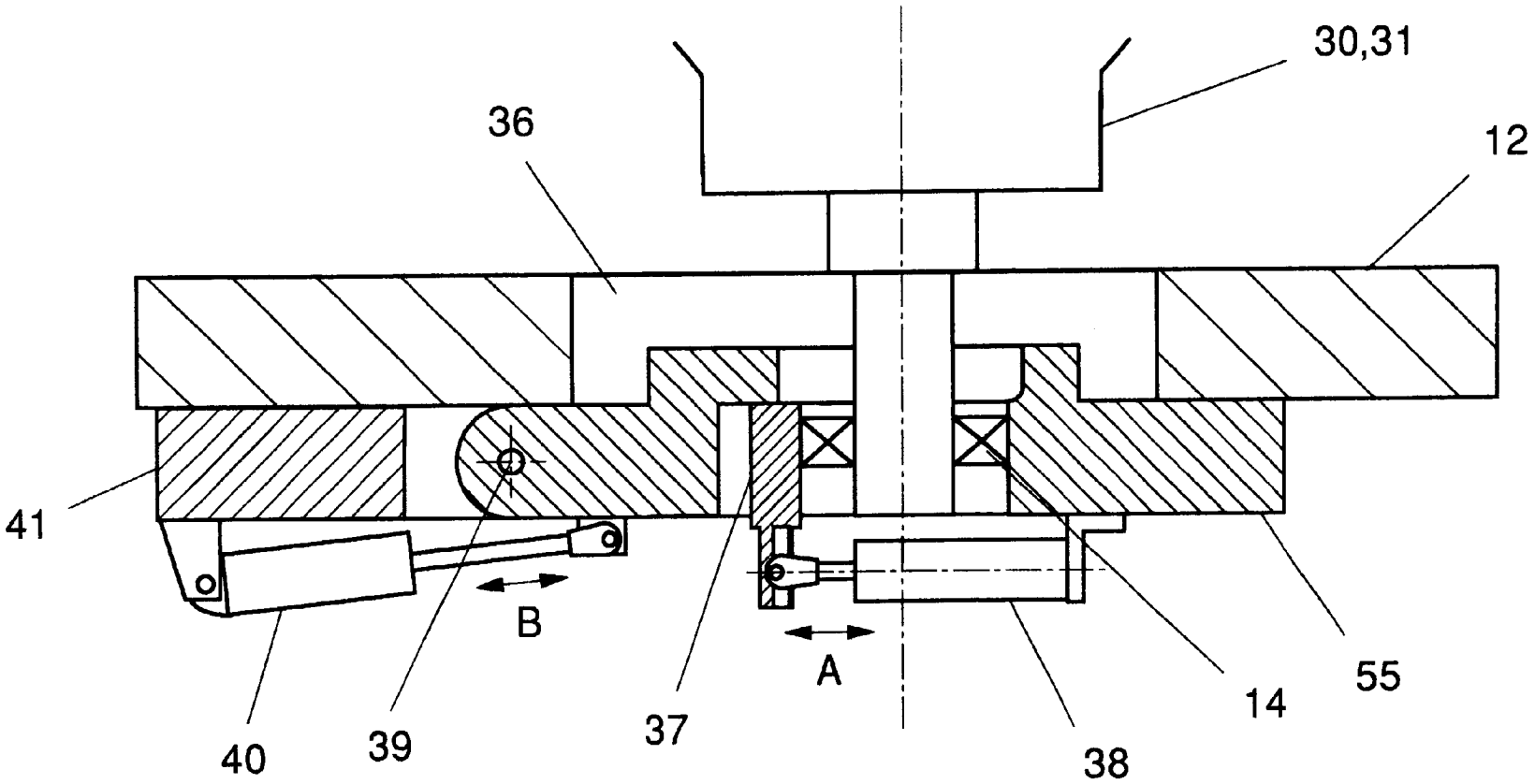
FIG. 7 is an enlarged cross-sectional view of FIG. 6 taken along the line VII—VII, in the direction of the arrows.

As shown particularly in FIG. 7, there is provided for each bearing 55 a cylinder 38 that is suitable for displacing a strut 37 of the bearing 55 in either direction of the double-headed arrow A, in order to loosen and release from the bearing 55 the shaft of the rollers 30 and 31 installed in the roller bearing 14.

Figure 9:
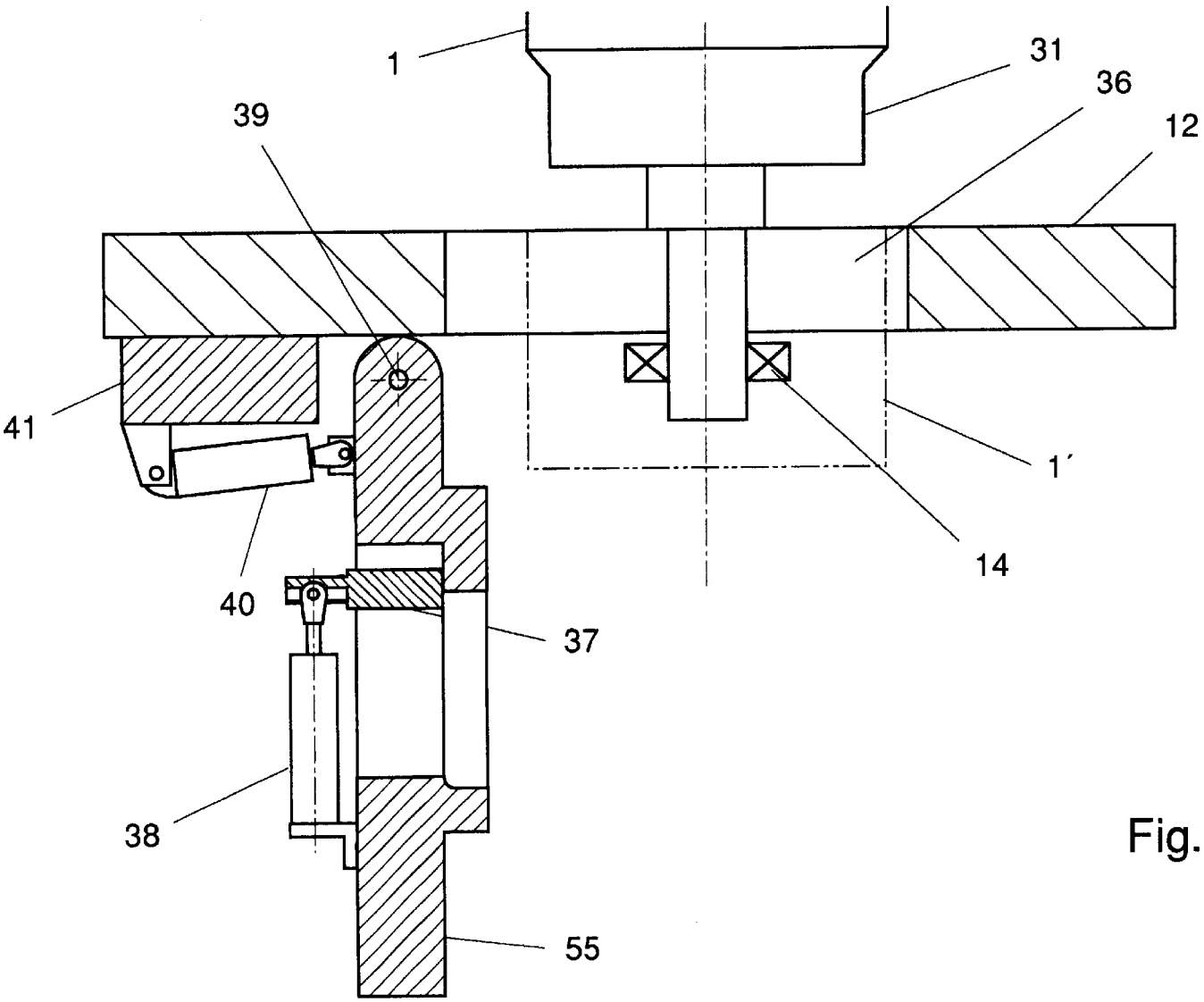
FIG. 9 is an enlarged cross-sectional view of FIG. 8 taken along the line IX—IX, in the direction of the arrows.

A cylinder 40 that is fastened to a support 41 then rotatingly entrains each bearing 55 about the spindle 39 (note FIG. 9).

The end of the cylinder 40 executes a translatory movement in accordance with the double-headed arrow B, as shown in FIG. 7. The bearing 55 opens in order to allow the operator to have access to the rollers 30 and 31 through the opening 36 and to withdraw the material web 1 that is in the form of a stocking rolled up on one of the rollers.

In this case, the roller 30, 31, the bearing of which is fixed, is self-supporting and is braced, on the control side, only on the roller bearings 15 and on a non-illustrated second support or holder.

Of course, the cylinders 38 and 40 may alternatively be replaced by manual controls.

Thus, according to this embodiment, after the printing machine has been switched off, the operator lets the air out of the inflatable sheath 32 of the rollers 30 and 31 and opens, at the operator side, the swivel or articulated bearing 55 that corresponds to the roller 30, 31 on which the torn material web has rolled up.

Figure 8:
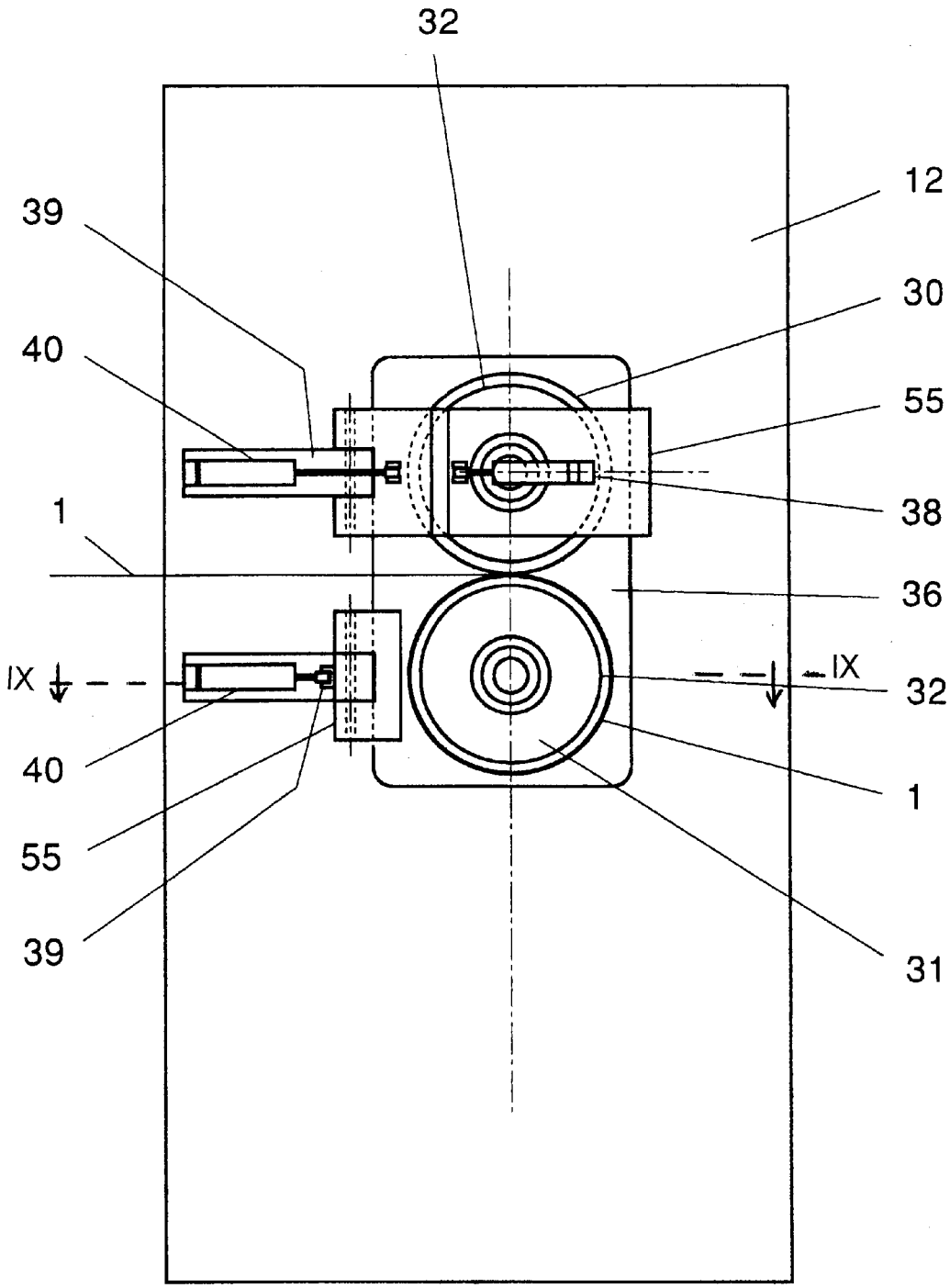
FIG. 8 is like that of FIG. 6, but wherein the clamping roller is open, an installation bearing being shown swung away therefrom.

The operator can withdraw the stocking-shaped printed material web through the opening 36 in accordance with the arrow F (note FIGS. 8 and 9).

When the material web has been removed from the web-catching device 9, the operator can close the articulated bearing 55 again and reintroduce the downline end of the material web into the rotary printing machine.

Of course, it is quite possible for this articulated-bearing system to be formed for the first embodiment of the web-catching device 9 described hereinbefore with reference to FIGS. 2*a* to 2*d*.

The advantage of this novel web-catching device described hereinabove is that the response time thereof is particularly short because very little mass (mass inertia) is displaced. All that is required is to displace an inflatable sheath 22, 32 that is pushed or slid onto a rigid body of the rollers.

The clamping rollers themselves do not execute any translatory movement.

If the web-tear detection system 8, 8' is powerful, the mechanical and pneumatic response times of the web-catching device are very short.

It is also possible, in this web-catching device, for the material web rolled up on one of the rollers to be withdrawn by letting the air out of the inflatable sheath and by opening the articulated bearing 55 on the operator side.

The invention of the instant application is not restricted in any way to the embodiments that have been described and illustrated; a person skilled in the art will know how to perform any suitable changes.

Figure 11:
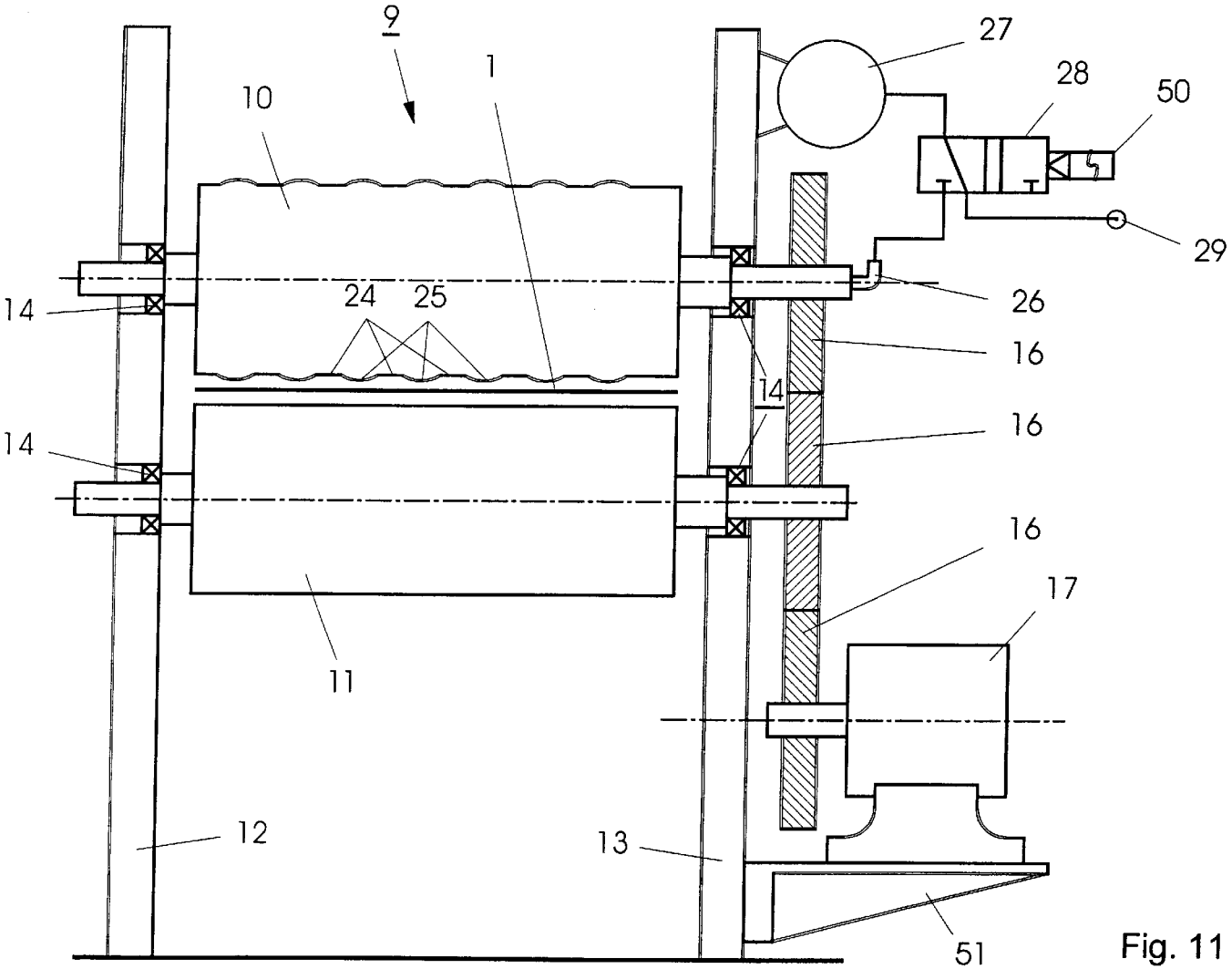
FIG. 11 is a view like that of FIG. 2*a* in which only one of the rollers has variable outer dimensions.

In particular, FIG. 11 shows an alternate embodiment of the clamping rollers in which a single clamping roller 10 of the web-catching device has variable outer main dimensions, and the other clamping roller 11 is a conventional roller, the rigid body of which has fixed main dimensions.

We claim:

1. A device for automatically catching a torn material web running through a rotary printing machine, comprising:

a pair of clamping rollers, respectively, disposed beneath and above the material web, said rollers being rotatingly entrainable and being able to clamp the web when a web tear is detected, at least one of said clamping rollers having variable outer main dimensions, at least one of said clamping rollers having a rigid cylindrical body with an outer circumferential surface;

an actuator connected to said at least one clamping roller for causing the outer main dimensions thereof to increase upon detection of a web tear, so as to clamp the torn material web between said clamping rollers; and at least one inflatable sheath fitted on the outer circumferential surface of the rigid cylindrical body of said one of said clamping rollers, said inflatable sheath connected to a pressure-medium supply for supplying a pressure medium to said inflatable sheath to inflate said sheath, upon detection of a web tear, so as to increase the outer main dimensions of said one of said clamping rollers.

2. The device according to claim 1, wherein said clamping rollers do not perform a translatory movement.

3. The device according to claim 1, wherein said inflatable sheath is formed by a sleeve with a deformable wall slidable onto said rigid cylindrical body of the respective clamping roller and clampable thereon, said wall of said sleeve being preformed so that, along the width of said roller, a plurality of inflatable chambers which are connected to said pressure-medium supply are defined with the circumferential surface of said rigid body.

4. The device according to claim 1, wherein said inflatable sheath comprises a sleeve with a deformable wall that is slidable at both ends onto the rigid cylindrical body of the respective clamping roller and clampable thereon, said sleeve having, over a majority of the length thereof, an internal diameter greater than the external diameter of the rigid body of the respective roller, so that a free space is formed between said sleeve and said rigid body, and including clamping rings clampable around said sleeve on the rigid cylindrical body and distributed at regular intervals over the width of said roller, so as to define inflatable chambers connected to the pressure-medium supply.

5. The device according to claim 1, wherein said inflatable sheath comprises a plurality of individual sleeves, respectively, having a deformable wall, said individual sleeves being slidable successively onto the rigid cylindrical body of the respective clamping roller and clampable thereon, an inflatable chamber connected to the pressure-medium supply being defined between each of said individual sleeves and the respective roller.

6. The device according to claim 1, wherein each of said clamping rollers has a wave-shaped or corrugated cylindrical outer surface.

7. The device according to claim 6, wherein said two outer circumferential surfaces of said two clamping rollers have wave-shaped or corrugation profiles corresponding to one another so that, in a clamping position, outwardly projecting peaks of the waves or corrugations of the outer surface of one of said clamping rollers are supported on outwardly projecting peaks of the waves or corrugations of the outer surface of the other clamping roller.

8. The device according to claim 6, wherein said two outer circumferential surfaces of said two clamping rollers have wave-shaped or corrugation profiles offset by half a pitch spacing relative to the width of the rollers, so that, in a clamping state of said clamping rollers, outwardly projecting peaks of the waves or corrugations of the outer surface of one of said clamping rollers are supported on inwardly projecting peaks of the waves or corrugations of the outer surface of the other clamping roller.

9. The device according to claim 1, wherein the pressure-medium supply comprises a container connectable via a quick-action solenoid valve alternatively to a pressure-medium supply network and to a line network provided in the cylindrical rigid body of the clamping roller and terminating on the outer surface of said rigid body, and including a web-tear detection system for controlling said quick-action solenoid valve.

10. The device according to claim 9, wherein the pressure medium is compressed air.

11. The device according to claim 1, wherein said clamping rollers are installed for rotating in bearings on the operator side, said bearings being swivellable about a spindle for quickly releasing an access opening to said clamping rollers.

12. The device according to claim 11, wherein each of said swivel bearings is linked to a respective spindle as a pressure-cylinder system.

13. The device according to claim 1, wherein said two clamping rollers have variable outer main dimensions.

14. The device according to claim 1, wherein only one of said two clamping rollers has variable outer main dimensions.

* * * * *